US005541717A

United States Patent [19]

Saito et al.

[11] Patent Number: 5,541,717

[45] Date of Patent: Jul. 30, 1996

[54] CLEANING METHOD FOR CONTACT CHARGING MEANS IN IMAGE FORMING APPARATUS

[75] Inventors: Hitoshi Saito, Mie-Ken; Koji Uno; Akihiro Kawasaki, both of Toyokawa; Masashi Yamamoto, Settsu, all of Japan

[73] Assignee: Minolta Co., Ltd., Osaka, Japan

[21] Appl. No.: 551,665

[22] Filed: Nov. 1, 1995

[30] Foreign Application Priority Data

Nov. 4, 1994 [JP] Japan ..... 6-271184

[51] Int. Cl.[6] ..... G03G 21/00

[52] U.S. Cl. ..... 355/269; 355/296

[58] Field of Search ..... 355/269, 265, 355/219, 296–304

[56] References Cited

U.S. PATENT DOCUMENTS 4,470,693 9/1984 Dolan ..... 355/300
4,763,168 8/1988 Lindblad ..... 355/15
5,148,219 9/1992 Kohyama ..... 355/219
5,371,578 12/1994 Asano et al. ..... 355/219

FOREIGN PATENT DOCUMENTS 1-65574(A) 3/1989 Japan .
4-32685 8/1992 Japan .

*Primary Examiner*—Joan H. Pendegrass
*Assistant Examiner*—Quana Grainger
*Attorney, Agent, or Firm*—Brinks Hofer Gilson & Lione

[57] ABSTRACT

A cleaning method for a contact type charger in an cleanerless image forming apparatus. The method includes a step of switching bias voltages applied to the contact type charger and a develop/cleaning device from first level to a second level so as to release developer adhering to the contact type charger onto an image-bearing member as well as to collect a part of the developer moved onto the image-bearing member by the developing/cleaning device, and a step of switching the bias voltage from the second level to the first level so as to collect the rest of the developer released onto the image-bearing member by the develop/cleaning device.

5 Claims, 6 Drawing Sheets

Non-contact transfer type
FIG.6A power ON/cover closed cleaning sequence
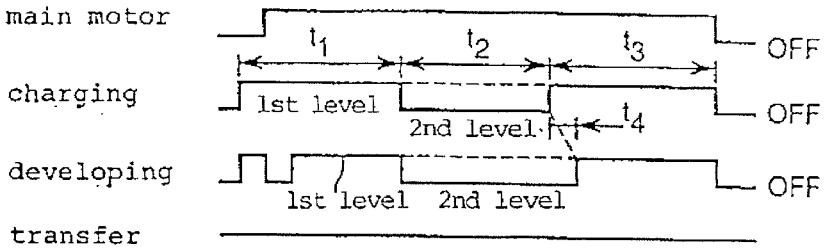
FIG.6B pre-rotation cleaning sequence
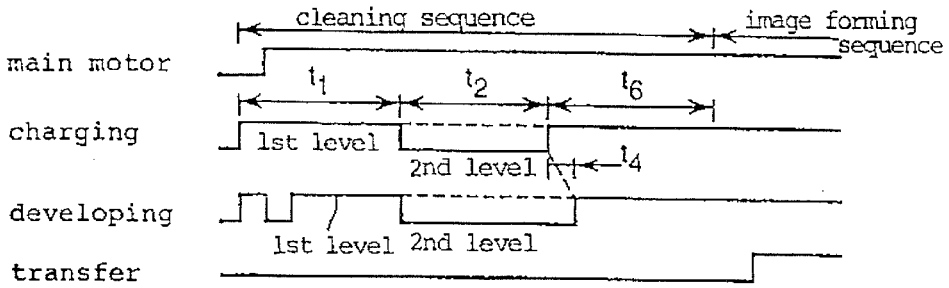
FIG.6C image interval cleaning sequence
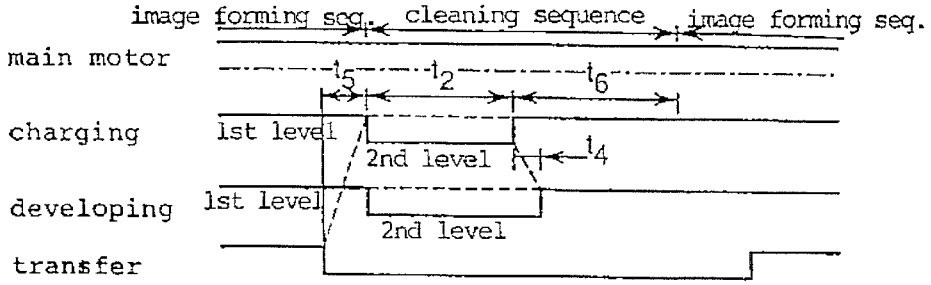
FIG.6D post rotation cleaning sequence
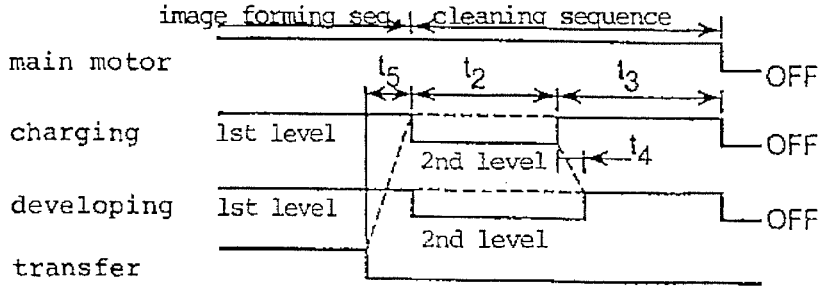

contact transfer type
FIG.7A power ON/cover closed cleaning sequence
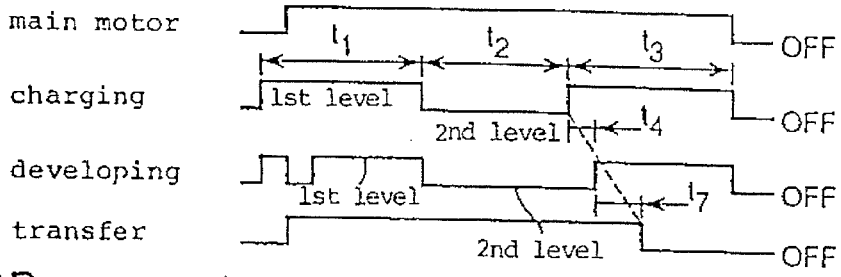
FIG.7B pre-rotation cleaning sequence
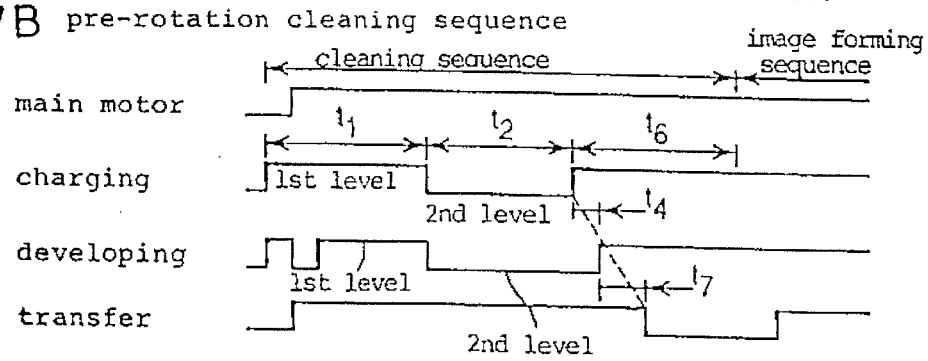
FIG.7C image interval cleaning sequence
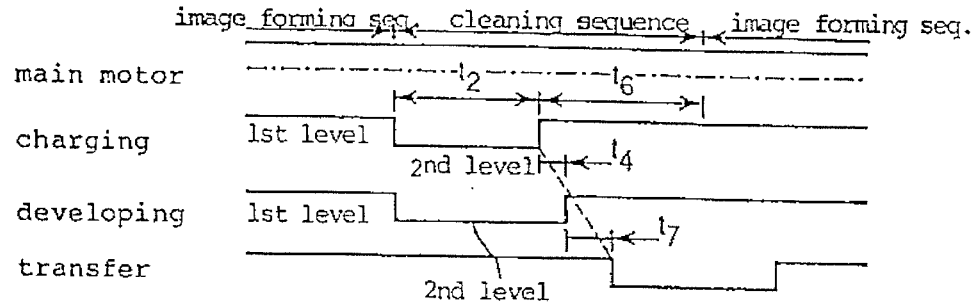
FIG.7D post rotation cleaning sequence
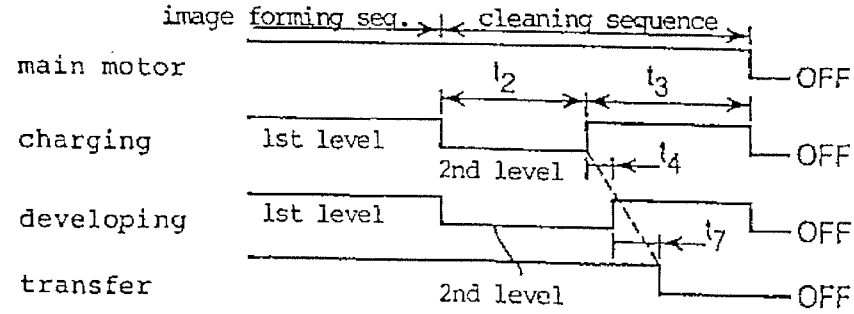

CLEANING METHOD FOR CONTACT CHARGING MEANS IN IMAGE FORMING APPARATUS

BACKGROUND OF THE INVENTION

FIELD OF THE INVENTION

The present invention relates to a cleaning method, and specifically a cleanerless cleaning method, for a contact charging means in image forming apparatus of an electrophotographic type such as copiers, printers and the like.

DESCRIPTION OF THE RELATED ART

Conventionally, as image forming apparatuses of the electrophotographic type are known to include cleanerless image forming apparatus is known which comprises an image-bearing member, contact charging means such as a brush or the like to uniformly charge the surface of said image-bearing member, optical exposure means for forming an electrostatic latent image on the surface of said image-bearing member in accordance with image information, developing/cleaning means for developing said latent image with developer which renders said image visible and at the same time cleaning residual developer from the surface of said image-bearing member, and transfer means for transferring the developed image from the surface of the image-bearing member onto a transfer member such as a paper sheet or the like.

In the aforesaid type of image forming apparatus, residual developer remaining on the surface of the image-bearing member after the developed image has been transferred is removed therefrom using a developing bias voltage applied to said developing/cleaning means after said developed image has been transferred without using a special cleaner.

Specifically, after uniform charging by the aforesaid contact charging means, the image portion of the image-bearing member which has reduced potential due to optical exposure receives electrostatically adhered developer from the developing/cleaning means to which a developing bias voltage is normally applied at the same time as development occurs. On the other hand, the non-image portion which is not subjected to optical exposure still has residual developer remaining on the image-bearing member after the previous developed image transfer, and the developing/cleaning means electrostatically removes said residual developer by applying a relatively higher potential compared to the aforesaid potential of the non-image portion via said developing bias voltage.

If the developer is charged with the same polarity as the charging polarity, i.e., the same polarity as the image-bearing member, residual developer remaining on the image-bearing member after the developed image is transferred can be removed as described above.

It happens that some developer other than the developer charged to the aforesaid charging polarity may be present and may have an opposite polarity. Therefore, in cleanerless image forming apparatus, such opposite polarity developer may be electrostatically adhered to the contact charging means during printing there by soiling said means and accumulating thereon so as to cause an increase of inadequate charging of the image-bearing member, as well as background fog on the transfer member.

U.S. patent application Ser. No. 5,148,219 discloses a cleaning method which proposes to eliminate the aforesaid disadvantages by applying a voltage of +100~+300 V (voltage application of −700~−1500 V is typical during image formation) so as to produce in the contact charging means the same polarity as the opposite polarity (+) developer, thereby forcibly moving the developer adhered to the contact charging means onto image-bearing member so as to be collected by the developing/cleaning means.

In the aforesaid cleaning method, however, produces a mixture of normal negative (−) charge polarity developer and opposite positive (+) charge polarity developer in the developer removed from the contact charging means, such that developer having the same polarity as the charge polarity of the image-bearing member is collected by the developing/cleaning means whereas developer having a polarity opposite that of the image-bearing member is not collected.

Therefore, the aforesaid developer having the opposite polarity (+) with respect to the polarity of the image-bearing member passes through the developing/cleaning device and again adheres to the contact charging means which receives a voltage during normal image formation, thereby producing background fogging and like disadvantages.

SUMMARY OF THE INVENTION

A main object of the present invention is to eliminate background fog produced when images are formed by a cleanerless image forming apparatus.

Another object of the present invention is to provide a cleaning method for a contact charging means in a cleanerless image forming apparatus which reliably eliminates soling by developer adhering to the contact charging means.

These and other objects of the present invention are accomplished by a method of cleaning a contact type charging device of an image forming apparatus which includes a photosensitive member, a contact type charging device for charging the photosensitive member, a developing device for developing a latent image formed by image exposure and for collecting toner remaining on said photosensitive member, the method comprising a first step of applying bias voltages of first level to said charging device and said developing device for forming an image, a second step of switching the bias voltages applied to said charging device and said developing device from the first level to a second level respectively, when forming no image, to release developer adhered to said charging device onto the photosensitive member and collect the developer by the developing device and a third step of switching the bias voltages from the second level to the first level respectively to charge developer having an opposite polarity to a charging polarity of said photosensitive member and having not been collected by said first step to the same polarity of said charging polarity of said photosensitive member, and to collect the charged developer by said developing device.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

FIG. 6 is a timing chart for charging, development, and transfer in an image forming apparatus of a non-contact transfer type using the present invention;

FIG. 7 is a timing chart for charging, development, and transfer in an image forming apparatus of a contact transfer type using the present invention.

DETAILED DESCRIPTION OF THE PREFERRED EMBODIMENTS

The preferred embodiments of the present invention are described hereinafter with reference to the accompanying drawings.

Figure 1:
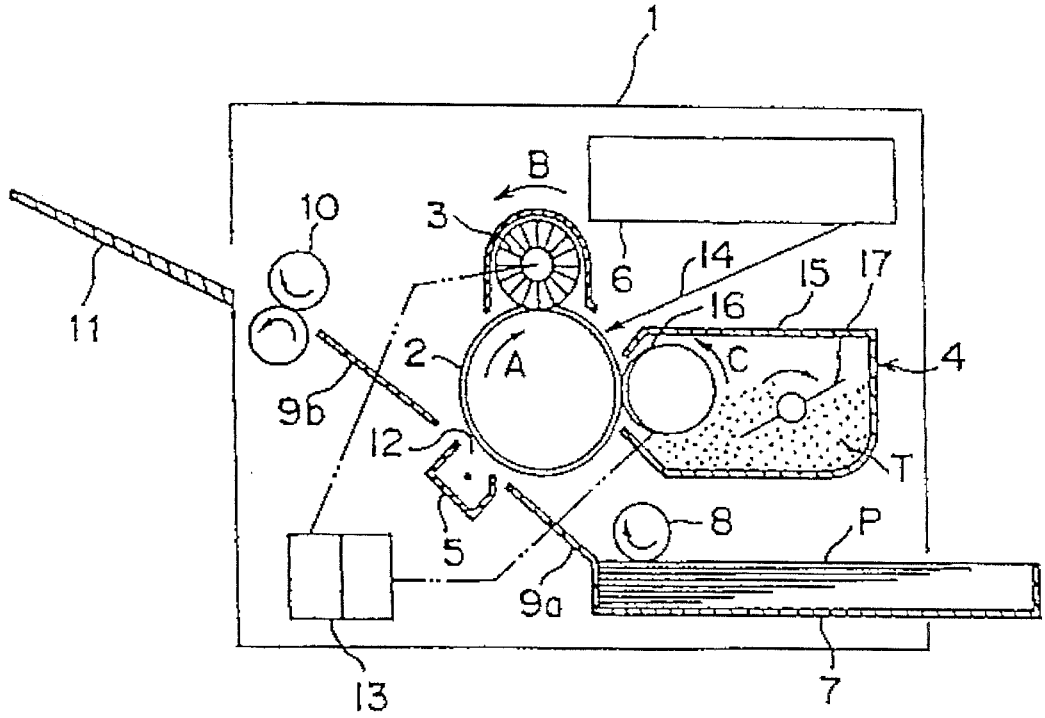
FIG. 1 briefly shows the construction of an image forming apparatus utilizing the cleaning method of the present invention.

FIG. 1 briefly shows the construction of an image forming apparatus using the cleaning method of the present invention. In the center of body 1 is provided a photosensitive member 2 as an image-bearing member provided with a thin surface layer formed of organic photoconductive material (OPC), and which is rotatable in the arrow A direction. Arranged sequentially around the periphery of photosensitive member 2 in the direction of rotation are charging brush 3, developing/cleaning device 4, and transfer charger 5, and a laser device 6 is disposed in the top section of body 1 at an inclination above photosensitive member 2.

A paper cassette 7 is provided below the aforesaid developing/cleaning device 4, and a feed roller 8 is disposed so as to abut paper P accommodated in said cassette 7. A paper transport path is formed from cassette 7 along guides *9a* and *9b* and passing transfer region 12 circumscribed by photosensitive member 2 and transfer charger 5, such that a sheet P fed through said path passes between a pair of fixing rollers 10 and is ejected to discharge tray 11 provided on body 1. A power source 13 is provided in the bottom section of body 1.

The previously mentioned charging brush 3 rotates in the arrow B direction, such that the leading end of the brush makes contact with the surface of photosensitive member 2 along the axial direction. Power source 13 is connected to charging brush 3 so as to supply, for example, −1200 V direct current (DC) voltage, or a switched DC voltage, or an alternating current (AC) overlaid on a DC voltage. Thus, a discharge is generated at the leading end of charging brush 3, which uniformly charges the surface of photosensitive member 2 to −600—900 V.

The previously mentioned laser device 6 irradiates the surface of photosensitive member 2 at a position medial to charging brush 3 and developing/cleaning device 4 via a laser beam 14 in accordance with image data, so as to form an electrostatic latent image by inducing decay of the electric potential on the uniformly charged surface of photosensitive member 2.

Developing/cleaning device 4 has a hopper casing 15 which accommodates a non-magnetic monocomponent toner T which is triboelectrically charged. This hopper casing 15 is provided with an opening toward photosensitive member 2, said opening facing a developing sleeve 16 which is rotatable in the arrow C direction and which confronts photosensitive member 2. Developing sleeve 16 is connected to the previously mentioned power source 13, which supplies thereto a bias voltage of, for example, −100—500 V (−300 V in the present embodiment) during normal image formation. A mixing blade 17 is provided within hopper casing 15 which rotates in a direction opposite to the rotation of developing 16 and which functions to prevent toner flocculation and supply toner to developing sleeve 16.

Transfer charger 5 applies a voltage having a polarity opposite to that of the toner through the back surface of paper P transported from cassette 7 to transfer region 12 in synchronization with the rotation of photosensitive member 2, so as to transfer the toner image from the surface of photosensitive member 2 onto paper P.

Figure 2:
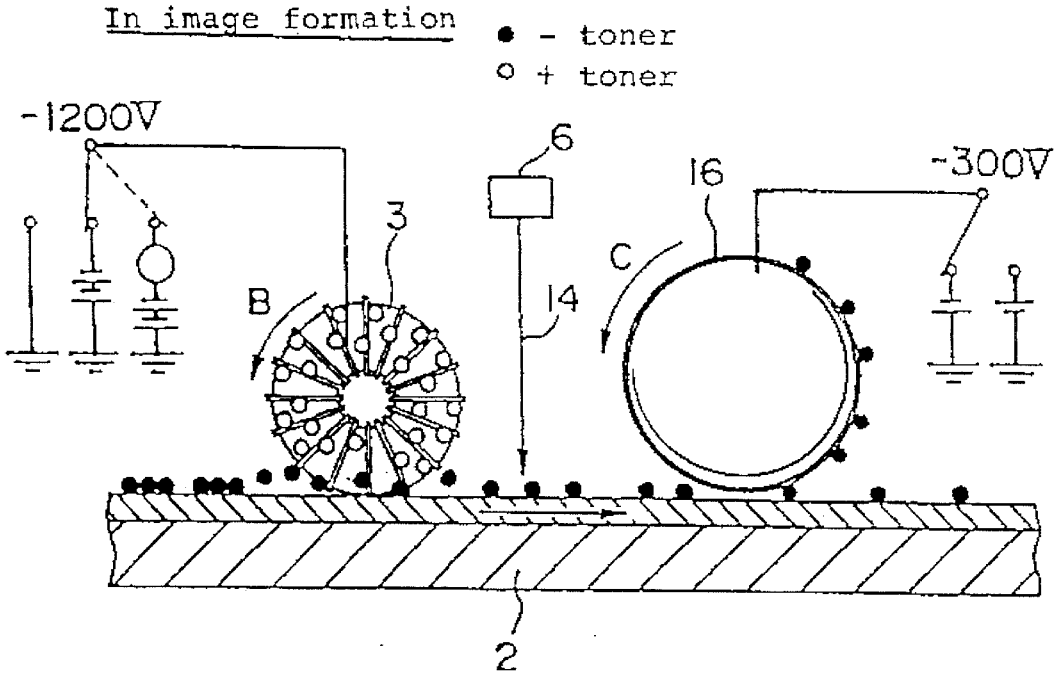
FIG. 2 is an illustration showing the toner movement when a bias voltage is applied during image formation.

Development, transfer, and collection of residual toner in the image forming apparatus of the previously described construction are described hereinafter with reference to FIGS. 1 and 2. In FIG. 2, (and FIGS. 3 and 4), photosensitive member 2 is shown in planar view for the sake of convenience of explanation.

A voltage comprising, for example, −1200 V DC, or an AC component overlaid on a DC voltage, is supplied to charging brush 3 during image formation, as shown in FIG. 2. Charging brush 3 not only charges photosensitive member 2 by means of the aforesaid voltage application, but also the leading end of the brush disperses somewhat the toner remaining after the previous image transfer (hereinafter referred to as "residual toner") by the rotational contact with the surface of photosensitive member 2, such that an indecipherable non-pattern is produced. In addition to the aforesaid mechanical action, charging brush 3 exerts a repulsion action with respect to toner of the same negative (−) polarity, and an acts to charge with a negative polarity the positive polarity toner after said positive toner is temporarily attracted electrostatically to charging brush 3 so as to return said toner to photosensitive member 2, and thereby accelerate the non-patternization of residual toner.

Then, the electric potential gap of the positive or negative electrostatic latent image remaining somewhat after transfer is eliminated by discharging or charging, so as to effectively electrostatically erase the residual latent image (hereinafter referred to as "memory"). This erasure applies a sufficient voltage to charging brush 3 to cause discharge of photosensitive member 2, and this discharge uniformly charges the surface of photosensitive member 2 to −600—900 V.

Thereafter, laser beam 14 is emitted from laser device 6 and irradiates the uniformly charged surface of photosensitive member 2 in accordance with image data. The electric potential of the laser irradiated region (hereinafter referred to as "image area") decays with respect to the regions not irradiated by the laser (hereinafter referred to as "non-image area), so as to form a new electrostatic latent image thereby.

When this newly formed latent image is moved to a position opposite developing sleeve 16 in conjunction with the rotation of photosensitive member 2, the toner maintained on the exterior surface of developing sleeve 16 is electrostatically adhered to the aforesaid image area based on the electric field formed by the applied bias voltage under the previously described conditions so as to accomplish development, and residual toner remaining in the aforesaid non-image area is electrostatically collected on developing sleeve 16 which has a relatively high potential compared to the potential of the non-image area of photosensitive member 2.

The developed toner image is moved to the transfer region 12 in accordance with the rotation of photosensitive member 2. At transfer region 12, a voltage having a polarity opposite the polarity of the toner is applied by transfer charger 5 from the back side of paper P transported thereto from cassette 7. Thus, toner is electrostatically adhered to paper P, such that the toner image is transferred from the surface of photosensitive member 2 onto paper P. The transported paper P is ejected to discharge tray 11 after the toner image is fixed thereon by a pair of fixing rollers 10.

Thus, the residual toner is collected at the same time as development is accomplished by the developing/cleaning device.

When printing is accomplished by the aforesaid image forming apparatus, toner charged with a polarity (+) opposite the polarity of the normal charge gradually adheres to and soils charging brush 3, and produces background fog. This background fog is due to inadequate charge injection of the toner which is charged with the aforesaid opposite polarity (+) which causes that the electrostatic attraction force of charging brush 3 is greater than the repulsive force.

In conventional examples, when a voltage of +100–+300 V is applied to charging brush 3 so as to cause the toner adhering to brush 3 to migrate to photosensitive member 2 in order to prevent the previously mentioned background fog, the positive polarity toner repulsed from the brush by the electrostatic repulsion force is discharged onto photosensitive member 2 together with the negative polarity toner mechanically collected in the brush interior by the brush action, and these positive polarity toner and negative polarity toner intermingle on photosensitive member 2.

Thus, although the negative polarity toner which has the same polarity as the charge polarity of photosensitive member 2 is collected by developing sleeve 16, the opposite polarity toner (positive polarity) cannot be collected therewith, such that soiling of charging brush 3 and background fog cannot be prevented.

Figure 3:
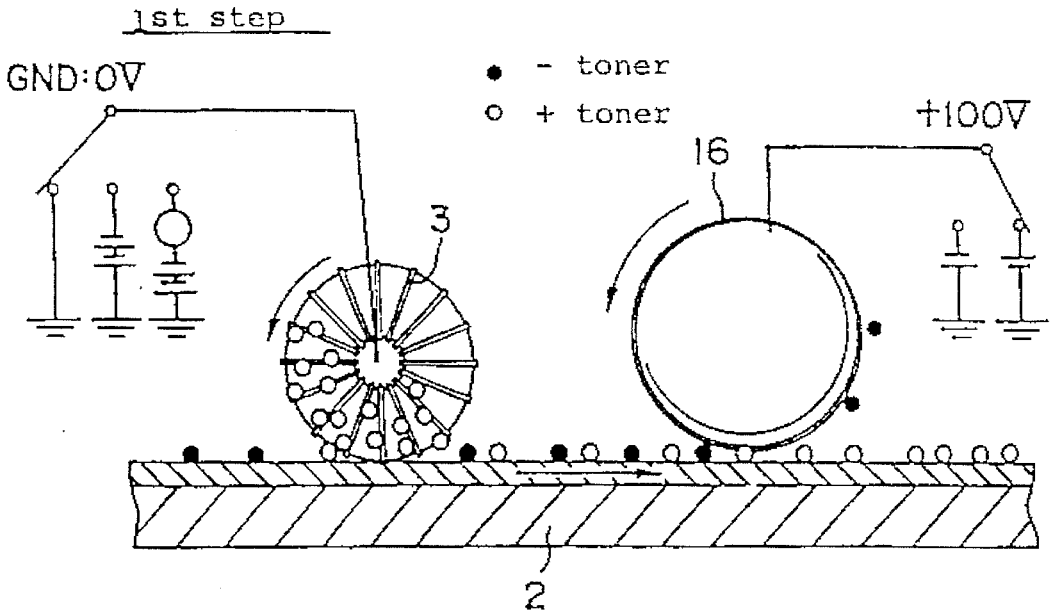
FIG. 3 illustrates the principle for eliminating toner soiling of the charging brush.
Figure 4:
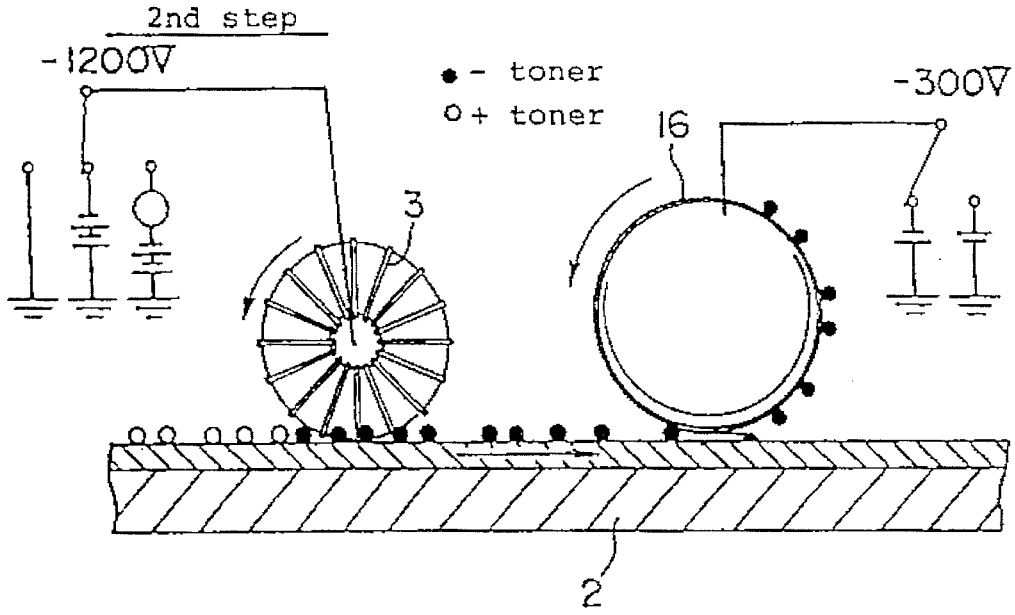
FIG. 4 illustrates the principle for eliminating toner soiling of the charging brush.

The cleaning method of the present embodiment which is capable of reliably eliminating toner soiling of charging brush 3 is described hereinafter with reference to FIGS. 3 and 4.

In a first step, the voltage applied to charging brush 3 is switched from a first level voltage of −1200 V DC voltage or voltage generated by overlaying AC component overlaid on a DC voltage to a second level positive or negative voltage near 0 V, and preferably a 0 V ground voltage (0 V in the present embodiment), so as to reverse the electric field between photosensitive member 2 and charging brush 3. This state continues a predetermined time and the toner adhering to charging brush 3 migrates to the surface of photosensitive member 2 by means of electrostatic action.

The reasons for the aforesaid second level voltage being a positive or negative voltage near 0 V and preferably a ground voltage of 0 V are as follows.

Since the amount of toner that migrates to photosensitive member 2 is proportional to the difference in potential between photosensitive member 2 and charging brush 3, more toner migrates to photosensitive member 2 the higher the potential of a polarity opposite to the polarity of the photosensitive member 2. However, the higher the potential of the voltage of opposite polarity with respect to the charge polarity of photosensitive member 2 supplied to charging brush 3, the more the surface of photosensitive member 2 is charged with the opposite polarity with respect to the current charging polarity and the more the previously mentioned memory is generated, resulting in inadequate charging and image irregularities.

Therefore, the second level voltage applied to charging brush 3 is desirably a voltage near 0 V which does not adversely affect photosensitive member 2, and is preferably a 0 V ground voltage which maximizes the difference of potential between the charging brush 3 and photosensitive member 2 without requiring a separate power circuit.

On the other hand, the bias voltage applied to the developing sleeve 16 is also applied simultaneously with the switching of the voltage to charging brush 3, and preferably is delayed only for the time required from the voltage switch of charging brush 3 until an optional region of photosensitive member 2 is rotated from charging brush 3 to developing sleeve 16, i.e., from a first level of −300 V to a second level of +100 V.

The toner which migrates from charging brush 3 to photosensitive member 2 is a mixture of positive polarity and negative polarity toner. As shown in FIG. 3, the toner having the same polarity (negative) as the charge polarity of the photosensitive member 2 electrostatically adheres to and collects on developing sleeve 16, whereas the toner having the opposite (positive) polarity with respect to the charge polarity of photosensitive member 2 is not collected and passes developing sleeve 16.

In a second step, the voltage applied to charging brush 3 is switched from the second level 0 V to the first level −1200 V by the time the toner having an opposite polarity (positive) with respect to the charge polarity of photosensitive member 2 and which was not collected in the first step and has passed developing sleeve 16 reaches the charging brush 3 in conjunction with the rotation of photosensitive member 2. In this state, the opposite polarity (positive) toner which has arrived at a position opposite charging brush 3 is charged to the same polarity (negative) as the charge polarity of photosensitive member 2 by said charging brush 3, as shown in FIG. 4.

The bias voltage applied to developing sleeve 16 is switched from +100 V (second level) to −300 V (first level) from the voltage switch of charging brush 3 for a delay only of the time required for the region of photosensitive member 2 confronting charging brush 3 to reach a position confronting developing sleeve 16. Thus, the toner charged with the same polarity (negative) as photosensitive member 2 is electrostatically attracted to and collected on developing sleeve 16.

Thus, the cleaning method of the present embodiment reliably removes the toner soiling charging brush 3.

In the second step, the bias voltage applied to developing sleeve 16 is switched to +100 V, such that toner is moved to developing sleeve 16 from a region on the surface of photosensitive member 2 having a charge potential of 0 V, thereby avoiding producing a solid image, and effectively preventing unnecessary consumption of toner.

Figure 5:
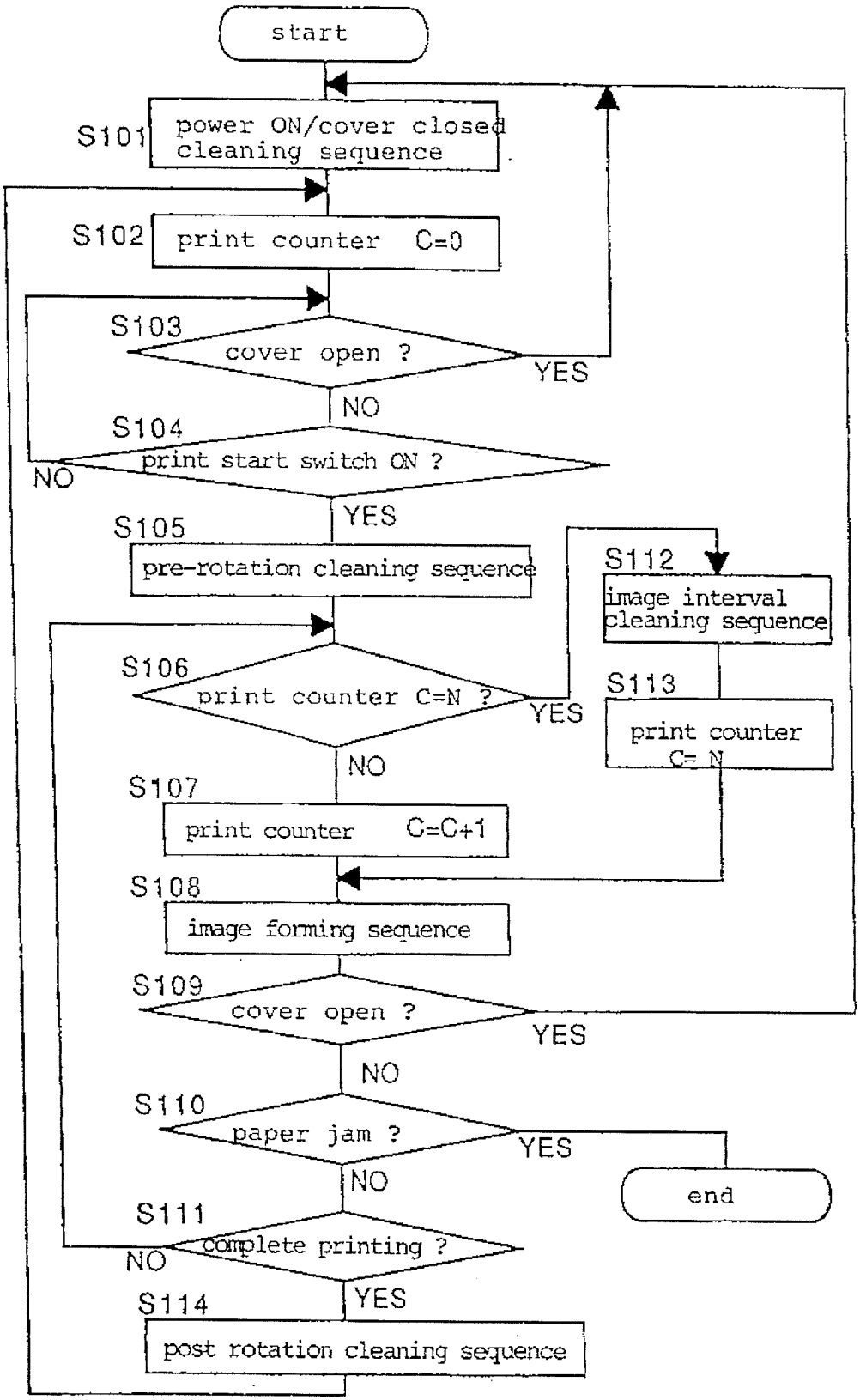
FIG. 5 shows an example of the operation flow of an image forming apparatus using the cleaning method of the present invention.

The cleaning method of the present embodiment can be adapted to image forming apparatus in a non-developing/transfer state, i.e., during non-image forming time. Specifically, these times are when the power source of the image forming apparatus is turned ON and the cover is closed, pre-rotation time, image interval time, post rotation time and the like. An example of the operation flow of the image forming apparatus during the aforesaid times is described below with reference to FIG. 5.

When the power source of the image forming apparatus is in the ON state and the side cover (hereinafter referred to simply as the "cover") of the apparatus is first opened to remove a paper jam or the like and then closed, in step S101, the power ON/cover closed cleaning sequence is started, and cleaning is accomplished by the cleaning method described in the aforesaid embodiment then in step S102 the cleaning print counter C is set at [0]. In step S103, a check is made to determine whether or not the cover is closed. If the cover is closed, a check is made in step S104 to determine whether or not the print start switch is ON; and said checks of steps S103 and S104 are repeated until the print start switch is ON.

When the cover is open in step S103, the routine returns to step S101 and the cleaning process is started again until the cover is closed.

When the print start switch is ON, the pre-rotation cleaning sequence is started in step S105. After cleaning ends, a check is made in step S106 to determine whether or not print counter C has attained a predetermined print number N; when C≠N, the print counter C value is incremented [1]in step S107, and thereafter the image forming sequence is started in step S108 and a single sheet is printed. When the 1-cycle print operation is completed, a check is made in step S109 to determine whether or not the cover has been operated. If the cover is not open, a check is made for paper jams in step S110, and if a paper jam is determined, the process ends.

When the cover is found to be open in step S109, the processing is identical to that of the previously described step S103.

On the other hand, if a paper jam is not determined, a check is made in step S111 to determine whether or not printing has been completed. When printing is continuous, a check is again made in step S106 to determine whether or not print counter C has attained print number N. When C≠N, processing is identical to that previously described, whereas when C=N, the image interval cleaning sequence is started in step S112 and cleaning is accomplished. After cleaning is completed, print counter C is reset at [0]in step S113, and the routine moves to the image forming sequence of step s108, and the printing operation continues.

Thereafter, after the determinations of steps S109 and S110 are made and a check is made in step S111 to determine whether or not printing is completed, post rotation cleaning sequence is started in step S114. After cleaning is completed, print counter C value is reset at [0]in step S102, and the processes of steps S103 and S104 are repeated.

The cleaning method application times of the present embodiment are not limited to the periods shown in the operation flow chart of the image forming apparatus described above, inasmuch as suitable combinations of various application times are possible.

Described below are the voltage switch timing for charging brush 3, developing sleeve 16, and transfer charger 5 in the various cleaning sequences of the power ON/cover closed time, pre-rotation time, image interval time, and post rotation time of the aforesaid application times of the present embodiment, said description being with reference to the timing chart of FIG. 6.

FIG. 6 relates to an image forming apparatus of a non-contact transfer type using a transfer charger. In the drawing, "charging," "developing," and "transfer" refer to charging brush 3, developing sleeve 16, and transfer charger 5, respectively. Times t1~t6 represent the times required for an optional region on the surface of photosensitive member 2 to rotate a distances described below.

t1: one rotation or more t2: less than 1 rotation t3: a distance equal to or greater than one rotation plus the distance from charging brush 3 to developing sleeve 16 t4: a distance from charging brush 3 to developing sleeve 16 t5: a distance equal to or greater than the distance from transfer charger 5 to charging brush 3 t6: a distance equal to or greater than one rotation plus the distance from charging brush 3 to the laser exposure position First, the power ON/cover closed cleaning sequence of FIG. 6A is described.

A first level voltage is applied to charging brush 3 slightly earlier than a voltage is supplied to the main motor operating the photosensitive member 2 and the like. After said first level voltage is maintained at least for time t1 required for photosensitive member 2 to rotate once, said voltage is switched to the second level.

The second level voltage is maintained at most only for a time t2 required for one rotation of photosensitive member 2. Thereafter, the bias voltage of charging brush 3 is switched again to the first level, said voltage is maintained at first level at least for time t3 required for an optional region of photosensitive member 2 to rotate once plus the distance from charging brush 3 to developing sleeve 16, after which said voltage is turned OFF.

The voltage to the main motor is turned OFF simultaneously with the developing sleeve 16.

Conversely, bias voltages are applied to charging brush 3 and developing sleeve 16, and when said bias voltages are supplied by the same high voltage transistor (not illustrated) of a high voltage power circuit, the switching of the bias voltage from first level to second level to developing sleeve 16 is accomplished at the same time as the switching of the bias voltage to charging brush 3 from first level to second level.

When separate high voltage transistors are provided, it is desirable that the switching time of the bias voltage to developing sleeve 16 from first level to second level is delayed only time t4 required for an optional region of photosensitive member 2 to rotate from charging brush 3 to developing sleeve 16 after the switching time of charging brush 3 from first level to second level, so as to efficiently collect soiling toner discharged from charging brush 3. (This point is identical in FIGS. 6B, 6C, 6D, and 7.)

The voltage switch of developing sleeve 16 from second level to first level is delayed only the aforesaid time t4 after the charging brush 4 switches from second level to first level, and thereafter the voltage is turned OFF at the same time as charging brush 3.

In the cleaning sequence of FIG. 6A described above, a bias voltage is not applied to transfer charger 5. (This point is identical in FIGS. 6B, 6C, and 6D.)

The cleaning sequence shown in FIG. 6B is substantially similar to that of FIG. 6A, but differs insofar as after the voltage to charging brush 3 is switched from second level to first level, the cleaning sequence continues at least a time t6 required for an optional region of photosensitive member 2 to rotate once plus the distance from charging brush 3 to the laser exposure position, whereupon the image forming sequence is executed.

The voltage supply to the main motor is naturally maintained even after the move to the image forming sequence, and a bias voltage is applied to transfer charger 5 after the move to the image forming sequence when the toner image formed on the surface of photosensitive member 2 reaches the position confronting charger 5.

The image interval cleaning sequence shown in FIG. 6C has the same voltage switch timing of charging brush 3 and developing sleeve 16 after the cleaning sequence starts and the same movement to the image formation sequence after the cleaning sequence ends as shown in FIG. 6B.

The starting point of the cleaning sequence differs from that of FIG. 6B, however, in that before the cleaning sequence starts, at least a time t5 required for photosensitive member 2 to rotate from transfer charger 5 to charging brush 3 elapses after the voltage application to transfer charger 5 is stopped following completion of a transfer, and thereafter the cleaning sequence starts.

The post rotation cleaning sequence shown in FIG. 6D is substantially similar to that of FIG. 6C, with the exception that after completion of the cleaning sequence, the voltages to charging brush 3, developing sleeve 16, and the main motor are turned OFF.

The timing chart of charging brush 3, developing sleeve 16, and a transfer roller type transfer means in an image forming apparatus of the contact transfer type shown in FIG. 7 is discussed below.

In FIG. 7, time t7 expresses the time required for an optional region on the surface of photosensitive member 2 to rotate from developing sleeve 16 to the transfer means.

Charging brush 3, developing sleeve 16, and the main motor are identical to those of FIG. 6.

In this case, when a second level bias voltage is supplied to developing sleeve 16, a bias voltage is applied to the transfer means even during an ongoing cleaning operation so as to prevent toner having a polarity opposite (positive) the charge polarity of photosensitive member 2 which is not collected by developing sleeve 16 from adhering to the transfer roller of the transfer means. For the same reason, the switch OFF timing of the bias voltages are such that after the bias voltage to developing sleeve 16 is switched from second level to first level, there is an elapse of at least a time t7 required for an optional region on photosensitive member 2 to rotate from developing sleeve 16 to the transfer means.

Although a non-magnetic monocomponent reversal developing method is used in the previously described embodiment, the cleaning method of the present invention is not limited to such an arrangement, and may be used with other well known magnetic monocomponent brush methods, two-component magnetic brush methods, as well as positive developing methods.

Although the present invention has been described by way of negative charging of the surface of a photosensitive member in the aforesaid embodiments, it is to be understood that positive charging of the surface of the photosensitive member may also be performed.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A method of cleaning a contact type charging device of an image forming apparatus which includes a photosensitive member, a contact type charging device for charging the photosensitive member, a developing device for developing a latent image formed by image exposure and for collecting toner remaining on said photosensitive member, the method comprising:

a first step of applying bias voltages of first level to said charging device and said developing device for forming an image;

a second step of switching the bias voltages applied to said charging device and said developing device from the first level to a second level respectively, when forming no image, to release developer adhered to said charging device onto the photosensitive member and collect the developer by the developing device; and a third step of switching the bias voltages from the second level to the first level respectively to charge developer having an opposite polarity to a charging polarity of said photosensitive member and having not been collected by said first step to the same polarity of said charging polarity of said photosensitive member, and to collect the charged developer by said developing device.

2. The method as claimed in claim 1, wherein the voltage applied to said charging device is a high potential voltage of the same polarity as the charging polarity of said photosensitive member in said first level, and is a ground voltage or a voltage around a ground voltage in said second level.

3. The method as claimed in claim 1, wherein the voltage applied to said developing device has the same polarity as the charging polarity of said photosensitive member in said first level, and has the opposite polarity to the charging polarity of said photosensitive member in said second level.

4. The method as claimed in claim 1, wherein a time to apply the voltage of the second level to said charging device is at most within a time required for one rotation of said photosensitive member.

5. An image forming apparatus comprising:

a photosensitive member;

a contact type charging device for charging the photosensitive member;

a first power source for applying voltage to said charging device;

a developing device for developing a latent image formed by image exposure and for collecting toner remaining on said photosensitive member after transferring the developed image;

a second power source for applying voltages to said developing device; and control means for controlling said first and second power sources to switch the voltage from a first level to a second level when forming no image to release developer adhered to said charging device onto the photosensitive member and collect the released developer by the developing device, and thereafter to switch the voltage from the second level to the first level respectively to charge developer which has not been collected in said first step to the same polarity of the charging polarity of said photosensitive member to be collected by said developing device.

* * * * *

UNITED STATES PATENT AND TRADEMARK OFFICE

CERTIFICATE OF CORRECTION

PATENT NO. : 5,541,717

DATED : July 30, 1996

INVENTOR(S) : Hitoshi Saito, et al.

It is certified that error appears in the above-identified patent and that said Letters Patent is hereby corrected as shown below:

In col. 10, line 15 (Claim 1, line 21), change "first" to --second--

In col. 10, line 56 (Claim 5, line 21), delete "in said first step".

Signed and Sealed this

Third Day of December, 1996

Bruce Lehman

*Attest:*

BRUCE LEHMAN

*Attesting Officer*

*Commissioner of Patents and Trademarks*